US010636245B2

(12) United States Patent
Vemuri et al.

(10) Patent No.: US 10,636,245 B2
(45) Date of Patent: Apr. 28, 2020

(54) AUDITING AND RECONCILIATION SYSTEM AND METHOD FOR GAMING MACHINES OPERATING A STAND-ALONE PROGRESSIVE JACKPOT

(71) Applicant: Bally Gaming, Inc., Las Vegas, NV (US)

(72) Inventors: Sudheer Vemuri, Las Vegas, NV (US); Mark Lowell, Las Vegas, NV (US); Ram Kumar Karnataka, Henderson, NV (US)

(73) Assignee: SG Gaming, Inc., Las Vegas, NV (US)

( * ) Notice: Subject to any disclaimer, the term of this patent is extended or adjusted under 35 U.S.C. 154(b) by 244 days.

(21) Appl. No.: 15/904,673

(22) Filed: Feb. 26, 2018

(65) Prior Publication Data

US 2018/0253934 A1 Sep. 6, 2018

Related U.S. Application Data

(60) Provisional application No. 62/466,653, filed on Mar. 3, 2017.

(51) Int. Cl.
*G07F 17/32* (2006.01)

(52) U.S. Cl.
CPC ..... *G07F 17/3223* (2013.01); *G07F 17/3209* (2013.01); *G07F 17/3211* (2013.01); *G07F 17/3258* (2013.01)

(58) Field of Classification Search
None
See application file for complete search history.

(56) References Cited

U.S. PATENT DOCUMENTS

2014/0057702 A1 2/2014 Lowell et al.

*Primary Examiner* — James S. McClellan
*Assistant Examiner* — Peter J Iannuzzi
(74) *Attorney, Agent, or Firm* — Marvin A. Hein

(57) ABSTRACT

In a casino environment including one or more gaming machines each operating one or more standalone progressive (SAP) jackpots defined by local SAP controllers, a system is set forth whereby the SAP jackpot information is additionally determined at a backend system. To synch the system and local controller determined values a mobile device is configured to display the system derived values which can be adjusted at a user interface at the mobile device to match the local controller derived values.

6 Claims, 8 Drawing Sheets

AUDITING AND RECONCILIATION SYSTEM AND METHOD FOR GAMING MACHINES OPERATING A STAND-ALONE PROGRESSIVE JACKPOT

CROSS-REFERENCE TO RELATED APPLICATION

This application claims the benefit of prior filed U.S. Provisional Patent Application Ser. No. 62/466,653 filed Mar. 3, 2017 titled "AUDITING AND RECONCILIATION SYSTEM AND METHOD FOR GAMING MACHINES OPERATING A STAND-ALONE PROGRESSIVE JACKPOT".

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND

Field of the Invention

This invention pertains generally to electronic gaming machines which operate a stand-alone progressive jackpot feature. More particularly it relates to a system for gathering, at a system level, progressive jackpot information such as coin-in, jackpot allocation and jackpot wins from machine jackpot controller and to reconciling the jackpot information as between the local controller and the system gathered information.

Background

It has been known to provide stand-alone progressive (SAP) jackpots for gaming machines. By stand-alone what is meant is that the progressive jackpot operates on the hosting gaming machine only and is not linked to other gaming machines either locally or on a wide area network. In some cases a progressive local controller is installed in the gaming machine when assembled by the original equipment manufacturer (OEM) provider. In other cases an after-market SAP controller is provided. In either situation the SAP jackpot local controller is configured at the gaming machine by a technician to (1) receive coin-in, i.e. bet, information from gaming machine coin-in meter or game processor, (2) allocate a percentage to one or more stand-alone progressive (SAP) jackpots, (3) drive one or more progressive displays to display the current values of the progressive jackpot(s), (5) poll the device for a jackpot qualifying outcome and, after a progressive is hit (6) reset the progressive(s) to their programmed start-up value. In a non-limiting the example where the gaming machine may host a video Poker game, a progressive jackpot may be awarded for a Royal Flush and another for four Aces with a 2, 3 or 4. The local controllers are configured according to the desire of the operator (governed by jurisdictional regulations and the game math) and may have different progressive jackpot start-up values, coin-in percentage allocations to the jackpot and reset values. The local controllers allocate a percentage to the current SAP as well as the start-up value for the SAP available after the current SAP is awarded. While it is possible to receive at a remote location controllers operating local area or wide area progressives, i.e. one or more progressive operating across plural gaming machines, it has not been feasible to obtain similar information from standalone progressive for various reasons such as different manufacture, unavailability of a local controller output connection or differing/proprietary communication protocols.

Due to the lack of centralized reporting for SAPs the reading of the meter(s) is done manually, at least once a day. This information is used reconcile against the set-up criteria, i.e. confirm whether the initial configuration was as intended and that the controller is functioning and reporting correctly. This is time and labor consuming, error prone and unavailable when a player is playing the gaming machine. Some venue internal procedures mandate the retention of the manual meter recordings for multiple years. Meter readings logbooks can be lost. Given the size of some modern casino properties and the number of he SAPs on the casino floor, the entire task can be expensive. It would be advantageous to provide a central repository for SAP data and which provides an easy mechanism to confirm that the centrally housed data is correct. The casino property as well as perhaps auditors and regulators regularly audit the operations of the SAPs to make sure the allocations and jackpots are according to design and are not over-holding or under-holding and the displays to the players and reporting records match the desired configuration. There is a need to provide for an easier and less labor intensive system to confirm and audit SAP games.

SUMMARY OF THE INVENTION

The present invention is directed to a system and method for auditing and reconciling stand-alone progressives for gaming machines. The one or more embodiments provide for faster and more accurate and efficient reconciliation than could be accomplished with manual auditing and reconciliation. In an embodiment a system is provided for auditing and/or reconciliation for gaming machines having an associated progressive jackpot local controller for operating a stand-alone progressive (SAP) jackpot in an environment including a communication network including at least wireless communication capability. The local controller is typically housed within the cabinet of the gaming machine providing the progressive jackpot. The local controller may be an original equipment installation (OEM) or an aftermarket controller and may be from varied providers. There may be numerous gaming machines each operating one or more SAP jackpots in a large casino environment. Each jackpot local controller at the gaming machine accesses coin-in data from, for example, the gaming machine coin-in meter, from which the contribution to the progressive jackpot is determined and the current value of the progressive jackpot is calculated and the displayed jackpot is incremented. The controller outputs the calculated value data to operate progressive jackpot displays to display to the player the controller-determined current progressive jackpot value. The system includes a stand-alone progressive (SAP) server including a memory. The SAP server is remote from the gaming machine and may service one or more casino properties through the network and/or world-wide web. A network connection is made between each controller/gaming machine and the SAP server to provide at least the coin-in data accessed by the local controller to the SAP server. The SAP server is configured to calculate from the received coin-in data the value of the progressive jackpot for each SAP according to program instructions for each progressive jackpot and to store in the memory the SAP server calculated values. The program instructions for the SAP server should mirror the local progressive controller's progressive accumulation and triggering game outcome configuration(s) so theoretically the SAP server and the local progressive controller should render the same accumulated progressive values according to desired design—making the SAP server a reliable, central, repository for SAP data for at least reporting and auditing purposes. That is, an operator may access the SAP server and retrieve accurate progressive data for each SAP in the gaming environment without having to individually gather information from each local controller/gaming machine.

A wireless communication host is provided for establishing communication between the SAP server and a user's mobile device for display of data representing the identification of the gaming machine and the SAP server-determined value for the progressive jackpot. For example a casino technician would approach a gaming machine having a SAP and enable an application on their mobile device. The technician would enter or acquire an input to identify the local controller/gaming machine subject to a SAP. The application is programmed to establish communication with the SAP server whereby the technician can receive data to display the then current, if not instantaneous, value of the SAP for the gaming machine as determined by the server to make sure the value(s) at the SAP server synch with those created by the progressive local controller and displayed at the gaming machine. If the user determines there is a discrepancy (which may occur based upon system outages, malfunctions, reconfiguration of the local controller or misconfiguration at the SAP server), the user may reconcile any progressive jackpot discrepancies by entering the appropriate input at the device—changing the respective value(s) at the server. In an embodiment the calculated value at local controller would be the "master", i.e. controlling value, with the SAP server value being the adjusted value to bring the local controller and SAP server values into agreement.

In an embodiment the gaming machine may have a displayed, identifying code such as a bar code, QR code or glyph and the mobile application may be configured to receive camera data of a view of the code to identify the gaming machine to the SAP host for accessing the SAP derived progressive data for the identified gaming machine.

Accordingly the system and method of the present invention provides for a central, electronic repository at the SAP server for the current values and other information associated with each SAP on the casino floor. A technician may on a routine basis confirm the SAP host derived data is reconciled with the progressive controller information derived by the progressive jackpot local controller. The routine reconciliations maintain according to the present invention confirms that the data at the SAP server, available for auditing, matches that of the progressive jackpot controller. Reconciliation is made faster, is more current and provides an accurate server based electronic record for each SAP.

DESCRIPTION

The Casino Gaming Enterprise Environment

The following description sets forth an example of a casino gaming enterprise environment including numerous gaming machines a plurality of which may host games having stand-alone progressive jackpots (SAPs).

Figure 1:
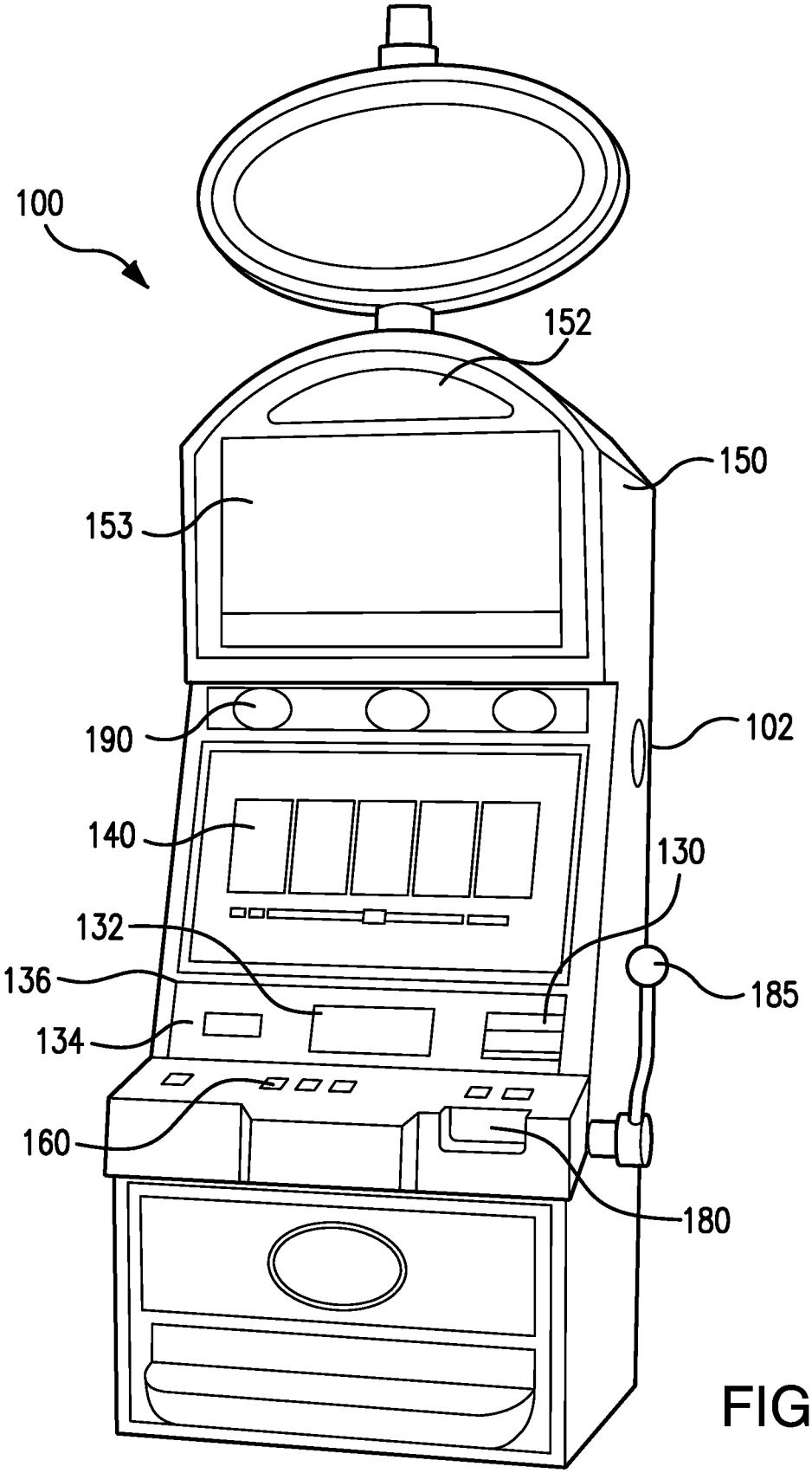
FIG. 1 is a perspective view of an example of a gaming machine which may host a stand-alone progressive jackpot (SAP) in accordance with one or more embodiments.

Referring to FIG. 1, gaming machine 100 capable of hosting a wagering-style game, e.g. slot machine game and which may be configured by a progressive jackpot local controller to include one or more progressive jackpot awards. Gaming machines 100 of the type shown in FIG. 1 are well known as are gaming machines 100 configured to provide one or more progressive jackpots. Progressive jackpots are typically arranged using a separate jackpot controller processor connected to and resident in the gaming machine 100. In other embodiments the progressive controller may be part of the original gaming machine 100 equipment (OEM) and programmed as a module for the operating software/firmware for the gaming machine 100.

The gaming machine 100 includes a cabinet housing 120, primary game display 140 upon which a primary game and feature game may be displayed, top box 150 which may display multiple progressives that may be won during play of the feature game, player-activated buttons 160, player tracking panel 136, bill/voucher acceptor 180 and one or more speakers 190. Cabinet housing 120 may be a self-standing unit that is generally rectangular in shape and may be manufactured with reinforced steel or other rigid materials which are resistant to tampering and vandalism.

In one or more embodiments, cabinet housing 120 houses a processor, circuitry, and software (not shown) for receiving signals from the player-activated buttons 160, operating the games, and transmitting signals to the respective displays and speakers. Any shaped cabinet may be implemented with any embodiment of gaming machine 100 so long as it provides access to a player for playing a game. For example, cabinet 120 may comprise a slant-top, bar-top, or table-top style cabinet, including a Bally Cinevision™ or CineReels™ cabinet. The operation of the exemplar gaming machine 100 is described more fully below.

The plurality of player-activated buttons 160 may be used for various functions such as, but not limited to, selecting a wager denomination, selecting a game to be played, selecting a wager amount per game, initiating a game, or cashing out money from gaming machine 100. Buttons 160 may be operable as input mechanisms and may include mechanical buttons, electromechanical buttons or touch screen buttons. Optionally, a handle 185 may be rotated by a player to initiate a game.

In one or more embodiments, buttons 160 may be replaced with various other input mechanisms known in the art such as, but not limited to, a touch screen system, touch pad, track ball, mouse, switches, toggle switches, or other input means used to accept player input such as a Bally iDeck™. One other example input means is a universal button module as disclosed in U.S. Pub. App. 2006/0247047, entitled "Universal Button Module," filed on Apr. 14, 2005, which is hereby incorporated by reference. Generally, the universal button module provides a dynamic button system adaptable for use with various games and capable of adjusting to gaming systems having frequent game changes. More particularly, the universal button module may be used in connection with playing a game on a gaming machine and may be used for such functions as selecting the number of credits to bet per hand.

Cabinet housing 120 may optionally include top box 150 which contains "top glass" 152 comprising advertising or pay out information related to the game or games available on gaming machine 100. Player tracking panel 136 includes player tracking card reader 134 and player tracking display 132. Voucher printer 130 may be integrated into player tracking panel 136 or installed elsewhere in cabinet housing 120 or top box 150.

Game display 140 may present a game of chance wherein a player receives one or more outcomes from a set of potential outcomes. For example, one such game of chance is a video slot machine game. In other aspects of the invention, gaming machine 100 may present a video or mechanical reel slot machine, a video keno game, video Poker game, a lottery game, a bingo game, a Class II bingo game, a roulette game, a craps game, a blackjack game, a mechanical or video representation of a wheel game or the like.

Mechanical or video/mechanical embodiments may include game displays such as mechanical reels, wheels, or dice as required to present the game to the player. In video/mechanical or pure video embodiments, game display 140 is, typically, a CRT or a flat-panel display in the form of, but not limited to, liquid crystal, plasma, electroluminescent, vacuum fluorescent, field emission, or any other type of panel display known or developed in the art. Game display 140 may be mounted in either a "portrait" or "landscape" orientation and be of standard or "widescreen" dimensions (i.e., a ratio of one dimension to another of at least 16×9). For example, a widescreen display may be 32 inches wide by 18 inches tall. A widescreen display in a "portrait" orientation may be 32 inches tall by 18 inches wide. Additionally, game display 140 preferably includes a touch screen or touch glass system (not shown) and presents player interfaces such as, but not limited to, credit meter (not shown), win meter (not shown) and touch screen buttons (not shown). An example of a touch glass system is disclosed in U.S. Pat. No. 6,942,571, entitled "Gaming Device with Direction and Speed Control of Mechanical Reels Using Touch Screen," which is hereby incorporated by reference in its entirety for all purposes.

Game display 140 may also present information such as, but not limited to, player information, advertisements and casino promotions, graphic displays, news and sports updates, or even offer an alternate game. This information may be generated through a host computer networked with gaming machine 100 on its own initiative or it may be obtained by request of the player using either one or more of the plurality of player-activated buttons 160; the game display itself, if game display 140 comprises a touch screen or similar technology; buttons (not shown) mounted about game display 140 which may permit selections such as those found on an ATM machine, where legends on the screen are associated with respective selecting buttons; or any player input device that offers the required functionality.

Cabinet housing 120 incorporates a single game display 140. However, in alternate embodiments, cabinet housing 120 or top box 150 may house one or more additional displays 153 or components used for various purposes including additional game play screens, animated "top glass," progressive meters or mechanical or electromechanical devices (not shown) such as, but not limited to, wheels, pointers or reels. The additional displays may or may not include a touch screen or touch glass system.

Figure 2A:
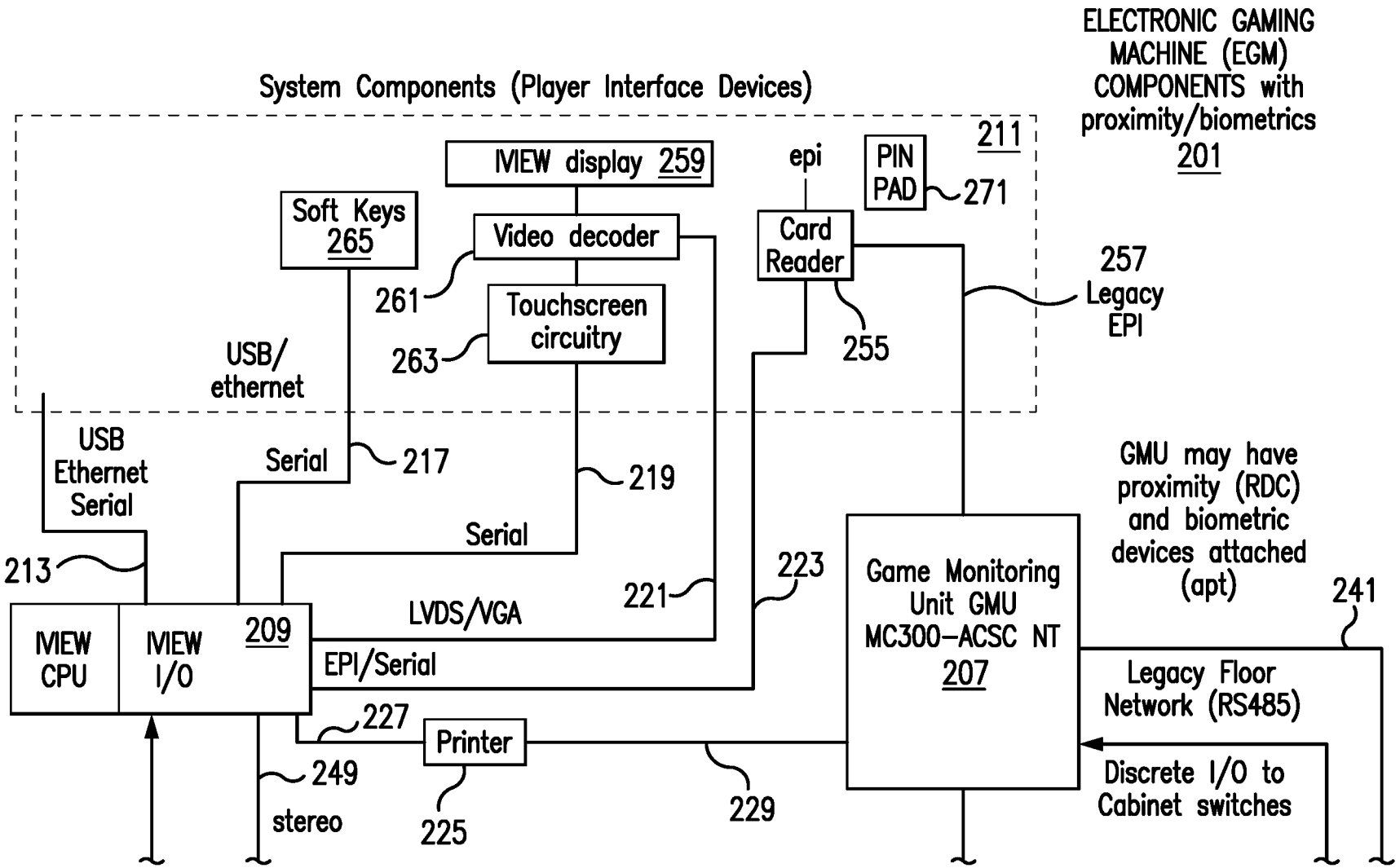
FIGS. 2A and 2B are a block diagram of the physical and logical components of the gaming machine of FIG. 1.
Figure 2B:
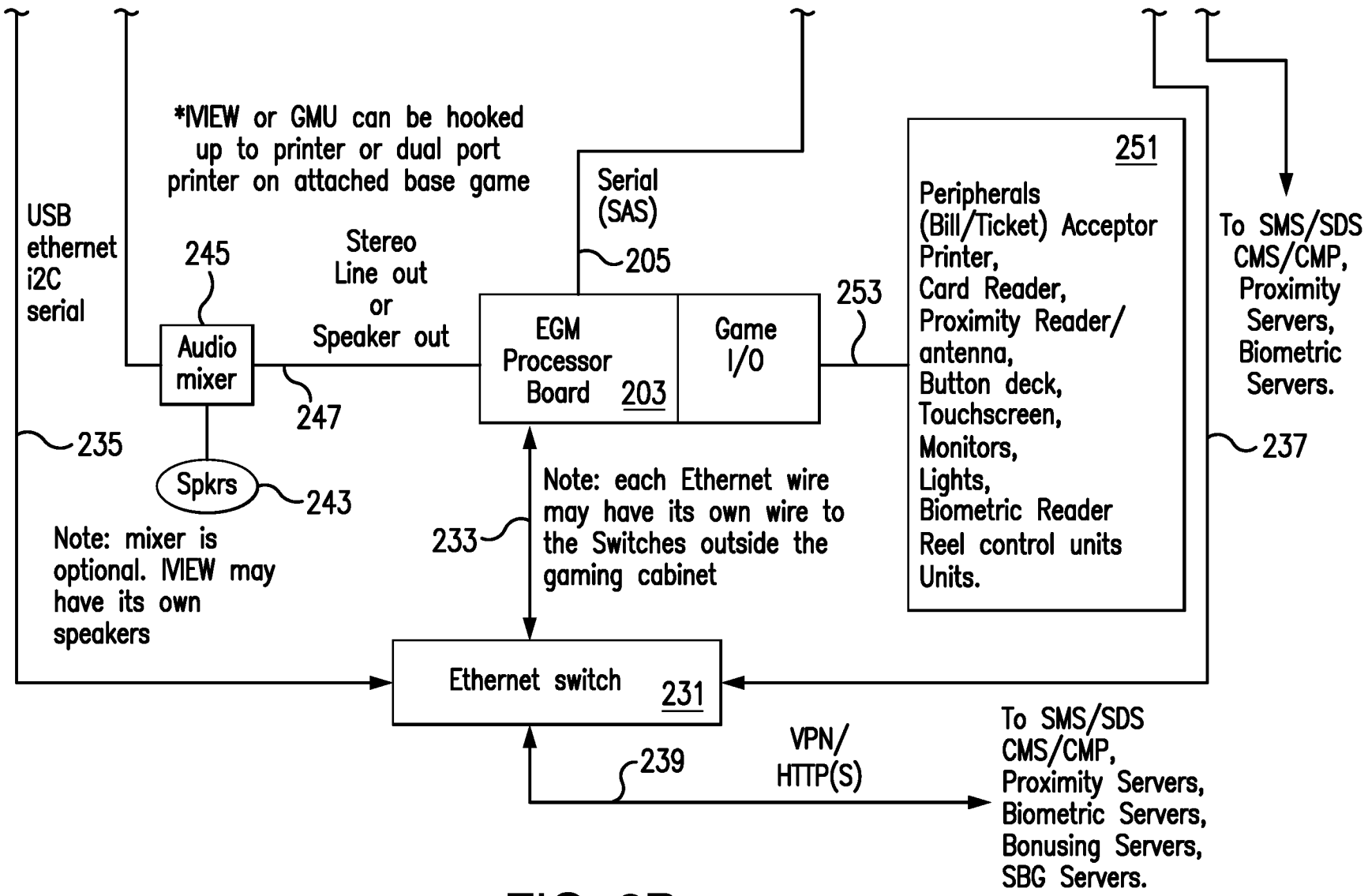

Referring to FIGS. 2A and 2B, the electronic components 201 for an electronic gaming machine 100 are shown in accordance with one or more embodiments. Electronic gaming machine 100 includes base game integrated circuit board 203 (EGM Processor Board) connected through serial bus line 205 to game monitoring unit (GMU) 207 (such as a Bally MC300 or ACSC NT), and player interface integrated circuit board (PIB) 209 connected to player interface devices 211 over bus lines 213, 215, 217, 219, 221, 223. Printer 225 is connected to PIB 209 and GMU 207 over bus lines 227, 229. Base game integrated circuit board 203, PIB 209, and GMU 207 connect to Ethernet switch 231 over bus lines 233, 235, 237. Ethernet switch 231 connects to a slot management system (SMS) and a casino management system (CMS) network over bus line 239. GMU 207 also may connect to the SMS and CMS network over bus line 241. Speakers 243 connect through audio mixer 245 and bus lines 247, 249 to base game integrated circuit board 203 and PIB 209. The proximity and biometric devices and circuitry may be installed by upgrading a commercially available PIB 209, such as a Bally iView™ unit. Coding executed on base game integrated circuit board 203, PIB 209, and/or GMU 207 may be upgraded to integrate a game in accordance with one or more embodiments of the invention described in Appendix A, as is more fully described below.

Peripherals 251 connect through I/O board 253 to base game integrated circuit board 203. For example, a bill/ticket acceptor is typically connected to a game input-output board 253 which is, in turn, connected to a conventional central processing unit ("CPU") base game integrated circuit board 203, such as an Intel Pentium microprocessor mounted on a gaming motherboard. I/O board 253 may be connected to base game integrated circuit board 203 by a serial connection such as RS-232 or USB or may be attached to the processor by a bus such as, but not limited to, an ISA bus. The gaming motherboard may be mounted with other conventional components, such as are found on conventional personal computer motherboards, and loaded with a game program which may include a gaming machine operating system (OS), such as a Bally Alpha OS. Base game integrated circuit board 203 executes a game program that causes base game integrated circuit board 203 to play a game. In one embodiment, the game program provides a slot machine game having adjustable multi-part indicia. The various components and included devices may be installed with conventionally and/or commercially available components, devices, and circuitry into a conventional and/or commercially available gaming machine cabinet, examples of which are described above.

When a player has inserted a form of currency such as, for example and without limitation, paper currency, coins or tokens, cashless tickets or vouchers, electronic funds transfers or the like into the currency acceptor, a signal is sent by way of I/O board 253 to base game integrated circuit board 203 which, in turn, assigns an appropriate number of credits for play in accordance with the game program. The player may further control the operation of the gaming machine by way of other peripherals 251, for example, to select the amount to wager via electromechanical or touch screen buttons. The game starts in response to the player operating a start mechanism such as a handle or touch screen icon. The game program includes a random number generator to provide a display of randomly selected indicia on one or more displays. In some embodiments, the random generator may be physically separate from gaming machine 100; for example, it may be part of a central determination host system which provides random game outcomes to the game program. Thereafter, the player may or may not interact with the game through electromechanical or touch screen buttons to change the displayed indicia. Finally, base game integrated circuit board 203 under control of the game program and OS compares the final display of indicia to a pay table. The set of possible game outcomes may include a subset of outcomes related to the triggering of a feature game. In the event the displayed outcome is a member of this subset, base game integrated circuit board 203, under control of the game program and by way of I/O Board 253, may cause feature game play to be presented on a feature display.

Predetermined pay out amounts for certain outcomes, including feature game outcomes, are stored as part of the game program. Such pay out amounts are, in response to instructions from base game integrated circuit board 203, provided to the player in the form of coins, credits or currency via I/O board 253 and a pay mechanism, which may be one or more of a credit meter, a coin hopper, a voucher printer, an electronic funds transfer protocol or any other pay out means known or developed in the art.

In various embodiments, the game program is stored in a memory device (not shown) connected to or mounted on the gaming motherboard. By way of example, but not by limitation, such memory devices include external memory devices, hard drives, CD-ROMs, DVDs, and flash memory cards. In an alternative embodiment, the game programs are stored in a remote storage device. In one embodiment, the remote storage device is housed in a remote server. The gaming machine may access the remote storage device via a network connection, including but not limited to, a local area network connection, a TCP/IP connection, a wireless connection, or any other means for operatively networking components together. Optionally, other data including graphics, sound files and other media data for use with the EGM are stored in the same or a separate memory device (not shown). Some or all of the game program and its associated data may be loaded from one memory device into another, for example, from flash memory to random access memory (RAM).

In one or more embodiments, peripherals may be connected to the system over Ethernet connections directly to the appropriate server or tied to the system controller inside the EGM using USB, serial or Ethernet connections. Each of the respective devices may have upgrades to their firmware utilizing these connections.

GMU 207 includes an integrated circuit board and GMU processor and memory including coding for network communications, such as the G2S (game-to-system) protocol from the Gaming Standards Association, Las Vegas, Nev., used for system communications over the network. As shown, GMU 207 may connect to card reader 255 through bus 257 and may thereby obtain player card information and transmit the information over the network through bus 241. Gaming activity information may be transferred by the base game integrated circuit board 203 to GMU 207 where the information may be translated into a network protocol, such as S2S, for transmission to a server, such as a player tracking server, where information about a player's playing activity may be stored in a designated server database.

PIB 209 includes an integrated circuit board, PID processor, and memory which includes an operating system, such as Windows CE, a player interface program which may be executable by the PID processor together with various input/output (I/O) drivers for respective devices which connect to PIB 209, such as player interface devices 211, and which may further include various games or game components playable on PIB 209 or playable on a connected network server and PIB 209 is operable as the player interface. PIB 209 connects to card reader 255 through bus 223, display 259 through video decoder 261 and bus 221, such as an LVDS or VGA bus.

As part of its programming, the PID processor executes coding to drive display 259 and provide messages and information to a player. Touch screen circuitry interactively connects display 259 and video decoder 261 to PIB 209, such that a player may input information and cause the information to be transmitted to PIB 209 either on the player's initiative or responsive to a query by PIB 209. Additionally soft keys 265 connect through bus 217 to PIB 209 and operate together with display 259 to provide information or queries to a player and receive responses or queries from the player. PIB 209, in turn, communicates over the CMS/SMS network through Ethernet switch 231 and busses 235, 239 and with respective servers, such as a player tracking server.

Player interface devices 211 are linked into the virtual private network of the system components in gaming machine 201. The system components include the iView processing board and game monitoring unit (GMU) processing board. These system components may connect over a network to the slot management system (such as a commercially available Bally SDS/SMS) and/or casino management system (such as a commercially available Bally CMP/CMS).

The GMU system component has a connection to the base game through a serial SAS connection and is connected to various servers using, for example, HTTPs over Ethernet. Through this connection, firmware, media, operating system software, gaming machine configurations can be downloaded to the system components from the servers. This data is authenticated prior to install on the system components.

The system components include the iView™ processing board and game monitoring unit (GMU) processing board. The GMU and iView™ can combined into one like the commercially available Bally GTM iView device. This device may have a video mixing technology to mix the EGM processor's video signals with the iView display onto the top box monitor or any monitor on the gaming device.

Figure 3:
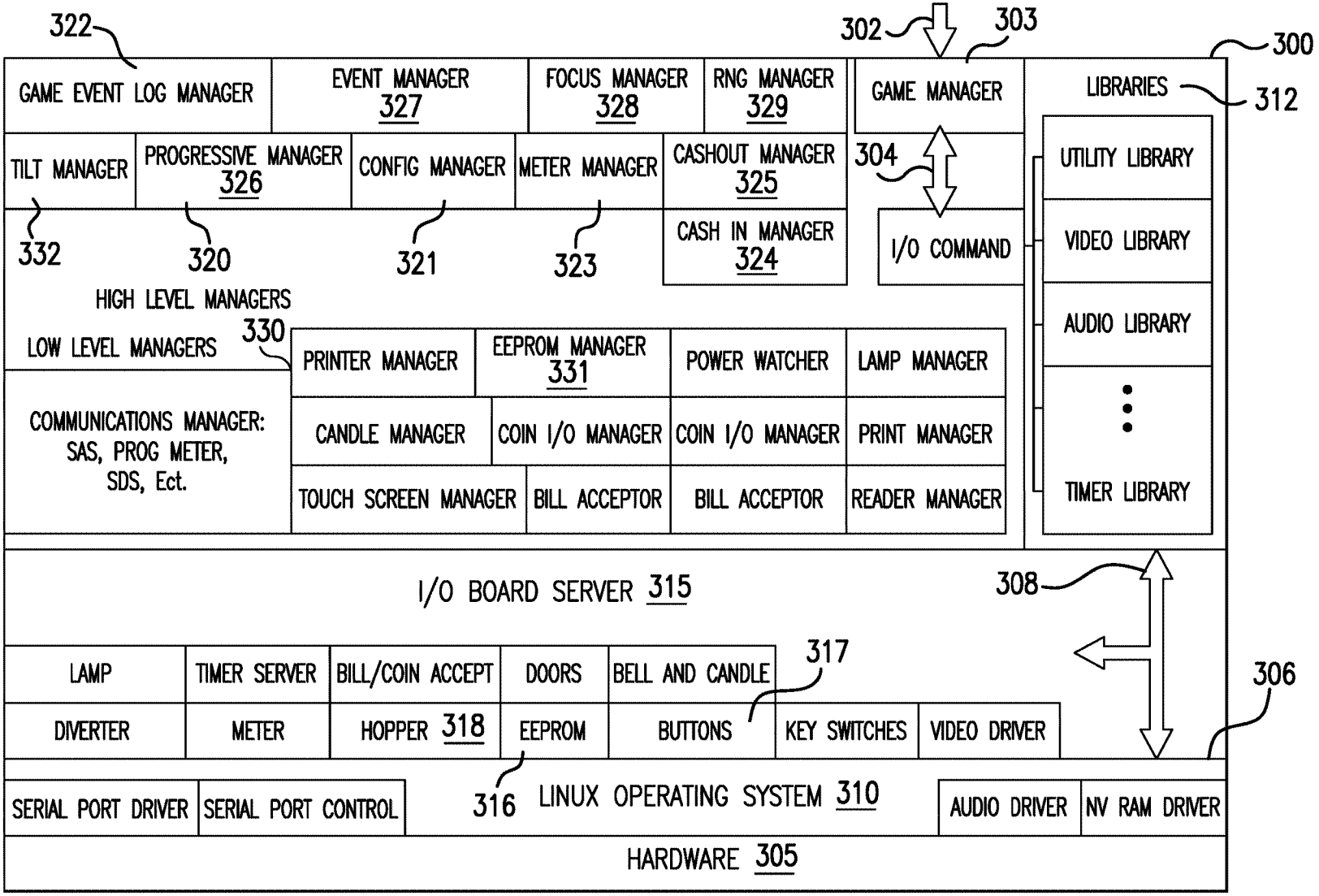
FIG. 3 is a block diagram of the logical components of a gaming kernel for the gaming machine.

In accordance with one or more embodiments, FIG. 3 is a functional block diagram of a gaming kernel 300 of a game program under control of base game integrated circuit board 203. The game program uses gaming kernel 300 by calling into application programming interface (API) 302, which is part of game manager 303. The components of game kernel 300 as shown in FIG. 3 are only illustrative, and should not be considered limiting. For example, the number of managers may be changed, additional managers may be added or some managers may be removed without deviating from the scope and spirit of the invention.

As shown in the example, there are three layers: a hardware layer 305; an operating system layer 310, such as, but not limited to, Linux; and a game kernel layer 300 having game manager 303 therein. In one or more embodiments, the use of a standard operating system 310, such a UNIX-based or Windows-based operating system, allows game developers interfacing to the gaming kernel to use any of a number of standard development tools and environments available for the operating systems. This is in contrast to the use of proprietary, low level interfaces which may require significant time and engineering investments for each game upgrade, hardware upgrade, or feature upgrade. The game kernel layer 300 executes at the user level of the operating system 310, and itself contains a major component called the I/O Board Server 315. To properly set the bounds of game application software (making integrity checking easier), all game applications interact with gaming kernel 300 using a single API 302 in game manager 303. This enables game applications to make use of a well-defined, consistent interface, as well as making access points to gaming kernel 300 controlled, where overall access is controlled using separate processes.

For example, game manager 303 parses an incoming command stream and, when a command dealing with I/O comes in (arrow 304), the command is sent to an applicable library routine 312. Library routine 312 decides what it needs from a device, and sends commands to I/O Board Server 315 (see arrow 308). A few specific drivers remain in operating system 310's kernel, shown as those below line 306. These are built-in, primitive, or privileged drivers that are (i) general (ii) kept to a minimum and (iii) are easier to leave than extract. In such cases, the low-level communications is handled within operating system 310 and the contents passed to library routines 312.

Thus, in a few cases library routines may interact with drivers inside operating system 310, which is why arrow 308 is shown as having three directions (between library utilities 312 and I/O Board Server 315, or between library utilities 312 and certain drivers in operating system 310). No matter which path is taken, the logic needed to work with each device is coded into modules in the user layer of the diagram. Operating system 310 is kept as simple, stripped down, and common across as many hardware platforms as possible. The library utilities and user-level drivers change as dictated by the game cabinet or game machine in which it will run. Thus, each game cabinet or game machine may have an base game integrated circuit board 1503 connected to a unique, relatively dumb, and as inexpensive as possible I/O adapter board 1540, plus a gaming kernel 300 which will have the game-machine-unique library routines and I/O Board Server 315 components needed to enable game applications to interact with the gaming machine cabinet. Note that these differences are invisible to the game application software with the exception of certain functional differences (i.e., if a gaming cabinet has stereo sound, the game application will be able make use of API 302 to use the capability over that of a cabinet having traditional monaural sound).

Game manager 303 provides an interface into game kernel 300, providing consistent, predictable, and backwards compatible calling methods, syntax, and capabilities by way of game application API 302. This enables the game developer to be free of dealing directly with the hardware, including the freedom to not have to deal with low-level drivers as well as the freedom to not have to program lower level managers 330, although lower level managers 630 may be accessible through game manager 303's interface 302 if a programmer has the need. In addition to the freedom derived from not having to deal with the hardware level drivers and the freedom of having consistent, callable, object-oriented interfaces to software managers of those components (drivers), game manager 303 provides access to a set of upper level managers 320 also having the advantages of consistent callable, object-oriented interfaces, and further providing the types and kinds of base functionality required in casino-type games. Game manager 303, providing all the advantages of its consistent and richly functional interface 302 as supported by the rest of game kernel 300, thus provides a game developer with a multitude of advantages.

Game manager 303 may have several objects within itself, including an initialization object (not shown). The initialization object performs the initialization of the entire game machine, including other objects, after game manager 303 has started its internal objects and servers in appropriate order. In order to carry out this function, the kernel's configuration manager 321 is among the first objects to be started; configuration manager 321 has data needed to initialize and correctly configure other objects or servers.

The upper level managers 320 of game kernel 300 may include game event log manager 322 which provides, at the least, a logging or logger base class, enabling other logging objects to be derived from this base object. The logger object is a generic logger; that is, it is not aware of the contents of logged messages and events. The log manager's (322) job is to log events in non-volatile event log space. The size of the space may be fixed, although the size of the logged event is typically not. When the event space or log space fills up, one embodiment will delete the oldest logged event (each logged event will have a time/date stamp, as well as other needed information such as length), providing space to record the new event. In this embodiment, the most recent events will thus be found in the log space, regardless of their relative importance. Further provided is the capability to read the stored logs for event review.

In accordance with one embodiment, meter manager 323 manages the various meters embodied in the game kernel 300. This includes the accounting information for the game machine and game play such as the one or more coin-in meters. There are hard meters (counters) and soft meters; the soft meters may be stored in non-volatile storage such as non-volatile battery-backed RAM to prevent loss. Further, a backup copy of the soft meters may be stored in a separate non-volatile storage such as EEPROM. In one embodiment, meter manager 323 receives its initialization data for the meters, during start-up, from configuration manager 321. While running, the cash in (324) and cash out (325) managers call the meter manager's (323) update functions to update the meters. Meter manager 323 will, on occasion, create backup copies of the soft meters by storing the soft meters' readings in EEPROM. This is accomplished by calling and using EEPROM manager 331. In an embodiment such as a aftermarket progressive jackpot local controller would connect to a coin I/O manager of the EEPROM manager 311 to obtain wager information for incrementing the progressive jackpot(s) and qualification for a progressive award. For example, if the game is video Poker with a progressive jackpot for a Royal Flush with max coin bet, the local controller may determine the qualification. In an embodiment the progressive jackpot local controller may be embodiment as a module of the configuration manager 321, progressive manager 326, game manager 303 or other software based component.

In accordance with still other embodiments, progressive manager 326 manages progressive games playable from the game machine. Event manager 327 is generic, like log manager 322, and is used to manage various gaming machine events. Focus manager 628 correlates which process has control of various focus items. Tilt manager 332 is an object that receives a list of errors (if any) from configuration manager 321 at initialization, and during game play from processes, managers, drivers, etc. that may generate errors. Random number generator manager 329 is provided to allow easy programming access to a random number generator (RNG), as a RNG is required in virtually all casino-style (gambling) games. RNG manager 329 includes the capability of using multiple seeds.

In accordance with one or more embodiments, a credit manager object (not shown) manages the current state of credits (cash value or cash equivalent) in the game machine, including any available winnings, and further provides denomination conversion services. Cash out manager 325 has the responsibility of configuring and managing monetary output devices. During initialization, cash out manager 325, using data from configuration manager 321, sets the cash out devices correctly and selects any selectable cash out denominations. During play, a game application may post a cash out event through the event manager 327 (the same way all events are handled), and using a call-back posted by cash out manager 325, cash out manager 325 is informed of the event. Cash out manager 325 updates the credit object, updates its state in non-volatile memory, and sends an appropriate control message to the device manager that corresponds to the dispensing device. As the device dispenses dispensable media, there will typically be event messages being sent back and forth between the device and cash out manager 325 until the dispensing finishes, after which cash out manager 325, having updated the credit manager and any other game state (such as some associated with meter manager 323) that needs to be updated for this set of actions, sends a cash out completion event to event manager 327 and to the game application thereby. Cash in manager 624 functions similarly to cash out manager 325, only controlling, interfacing with, and taking care of actions associated with cashing in events, cash in devices, and associated meters and crediting.

In a further example, in accordance with one or more embodiments, I/O server 315 may write data to the gaming machine EEPROM memory, which is located in the gaming machine cabinet and holds meter storage that must be kept even in the event of power failure. Game manager 303 calls the I/O library functions to write data to the EEPROM. The I/O server 315 receives the request and starts a low priority EEPROM thread 316 within I/O server 315 to write the data. This thread uses a sequence of 8 bit command and data writes to the EEPROM device to write the appropriate data in the proper location within the device. Any errors detected will be sent as IPC messages to game manager 303. All of this processing is asynchronous.

In accordance with one embodiment, button module 317 within I/O server 315, polls (or is sent) the state of buttons every 2 ms. These inputs are debounced by keeping a history of input samples. Certain sequences of samples are required to detect a button was pressed, in which case the I/O server 315 sends an inter-process communication event to game manager 303 that a button was pressed or released. In some embodiments, the gaming machine may have intelligent distributed I/O which debounces the buttons, in which case button module 317 may be able to communicate with the remote intelligent button processor to get the button events and simply relay them to game manager 303 via IPC messages. In still another embodiment, the I/O library may be used for pay out requests from the game application. For example, hopper module 318 must start the hopper motor, constantly monitor the coin sensing lines of the hopper, debounce them, and send an IPC message to the game manager 303 when each coin is paid.

Further details, including disclosure of lower level fault handling and/or processing, are included in U.S. Pat. No. 7,351,151 entitled "Gaming Board Set and Gaming Kernel for Game Cabinets" and provisional U.S. patent application No. 60/313,743, entitled "Form Fitting Upgrade Board Set For Existing Game Cabinets," filed Aug. 20, 2001; said patent and provisional are both fully incorporated herein by explicit reference.

Figure 4A:
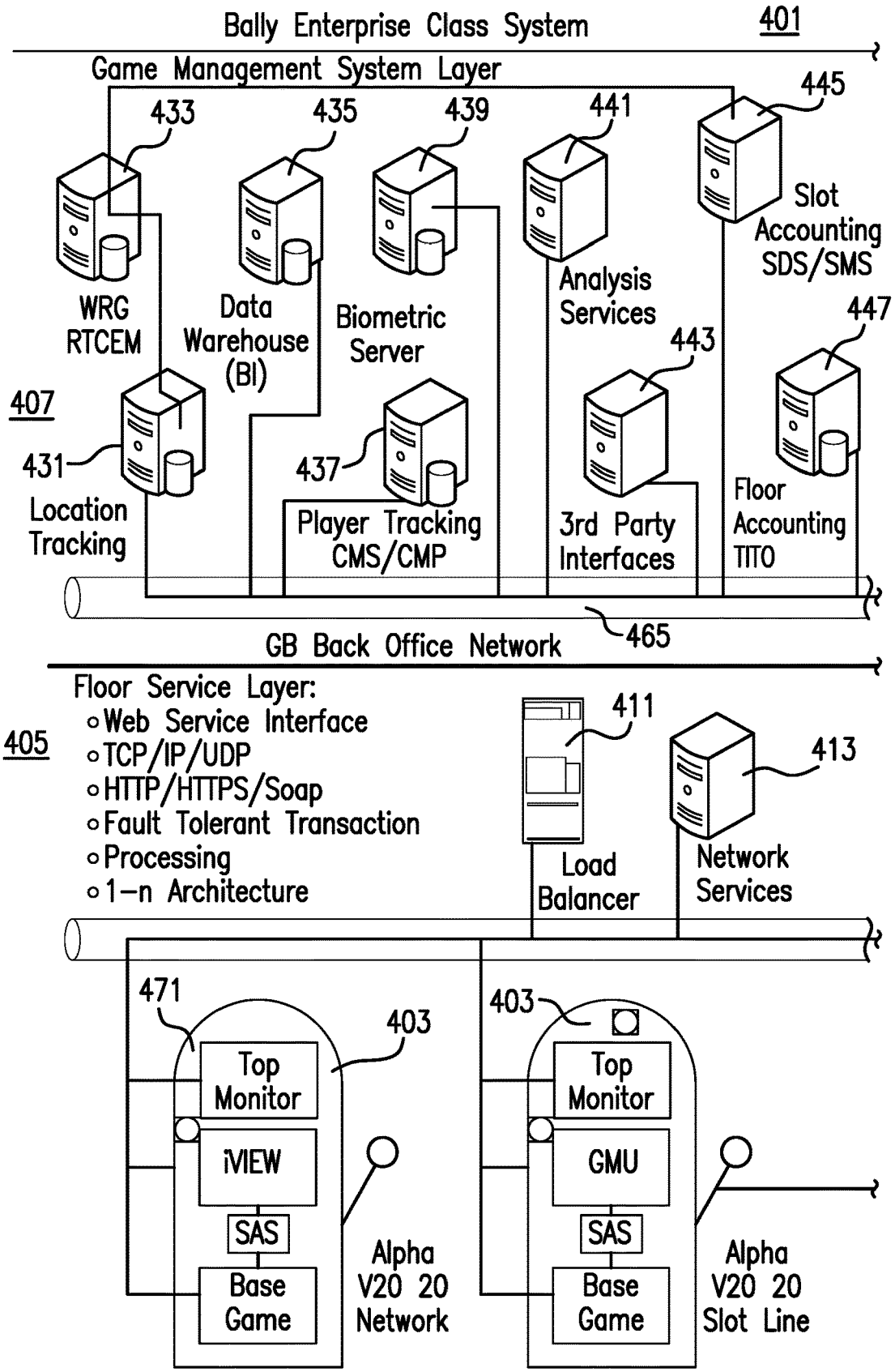
FIGS. 4A and 4B are a schematic block diagram showing an example of the hardware elements of a network for gaming machines in accordance with one or more embodiments.
Figure 4B:
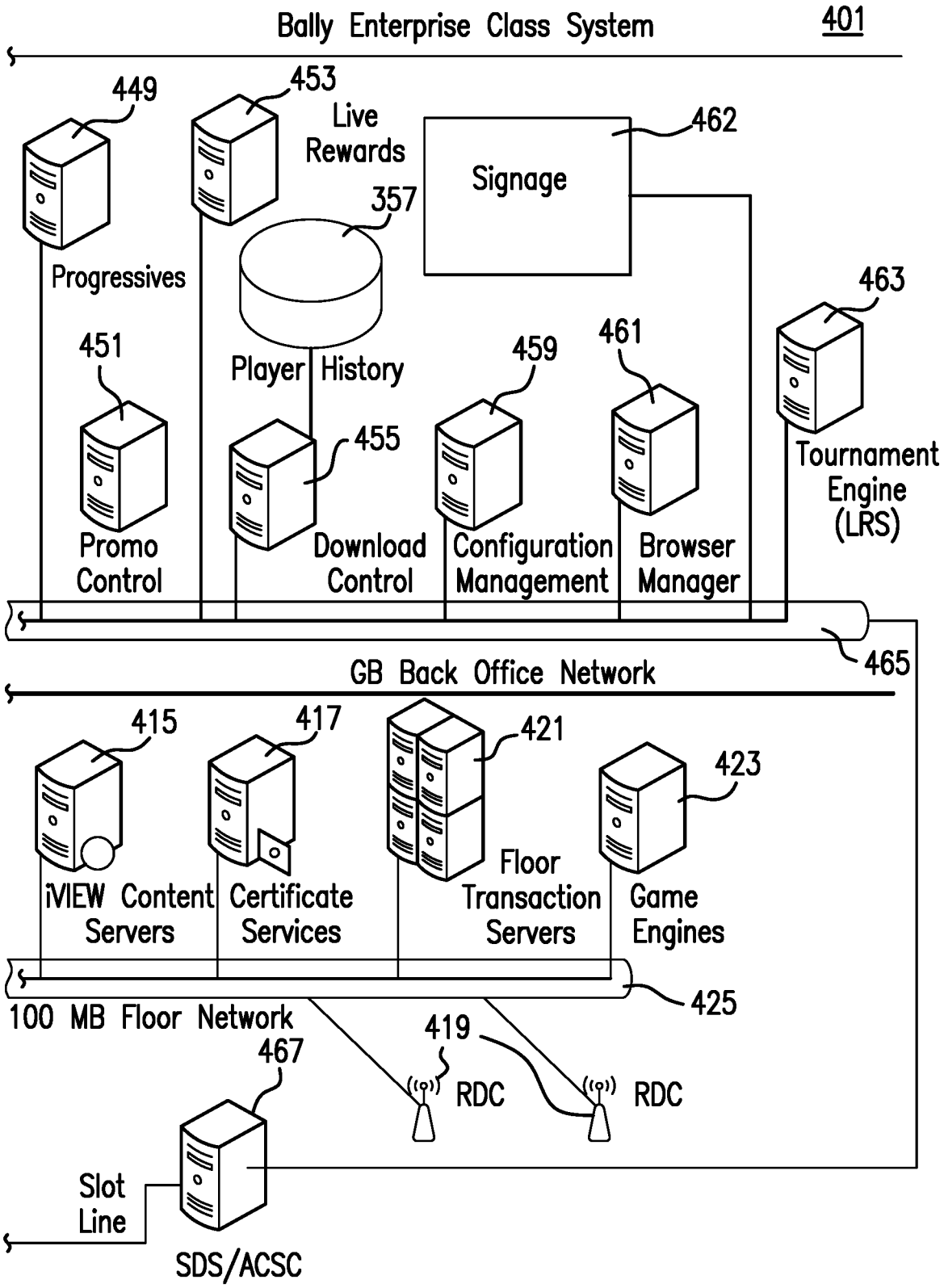

Referring to FIGS. 4A and 4B, an enterprise gaming system 401 is shown in accordance with one or more embodiments. Enterprise gaming system 401 may include one casino or multiple locations and generally includes a network of gaming machines 403, floor management system (SMS) 405, and casino management system (CMS) 407. SMS 405 may include load balancer 411, network services servers 413, player interface (iView) content servers 415, certificate services server 417, floor wireless dispatch receiver/transmitters (RDC) 419, floor transaction servers 421 and game engines 423, each of which may connect over network bus 425 to gaming machines 403. CMS 407 may include location tracking server 431, WRG RTCEM server 433, data warehouse server 435, player tracking server 437, biometric server 439, analysis services server 441, third party interface server 443, slot accounting server 445, floor accounting server 447, progressives server 449, promo control server 451, feature game (such as Bally Live Rewards) server 453, download control server 455, player history database 457, configuration management server 459, browser manager 461, tournament engine server 463 connecting through bus 465 to server host 467 and gaming machines 403. The various servers and gaming machines 403 may connect to the network with various conventional network connections (such as, for example, USB, serial, parallel, RS485, Ethernet). Additional servers which may be incorporated with CMS 407 include a responsible gaming limit server (not shown), advertisement server (not shown), and a control station server (not shown) where an operator or authorized personnel may select options and input new programming to adjust each of the respective servers and gaming machines 403. SMS 405 may also have additional servers including a control station (not shown) through which authorized personnel may select options, modify programming, and obtain reports of the connected servers and devices, and obtain reports. The various CMS and SMS servers are descriptively entitled to reflect the functional executable programming stored thereon and the nature of databases maintained and utilized in performing their respective functions.

Gaming machines 403 include various peripheral components that may be connected with USB, serial, parallel, RS-485 or Ethernet devices/architectures to the system components within the respective gaming machine. The GMU has a connection to the base game through a serial SAS connection. The system components in the gaming cabinet may be connected to the servers using HTTPs or G2S over Ethernet. Using CMS 407 and/or SMS 405 servers and devices, firmware, media, operating systems, and configurations may be downloaded to the system components of respective gaming machines for upgrading or managing floor content and offerings in accordance with operator selections or automatically depending upon CMS 407 and SMS 405 master programming. The data and programming updates to gaming machines 403 are authenticated using conventional techniques prior to install on the system components.

The Present Invention

Figure 5:
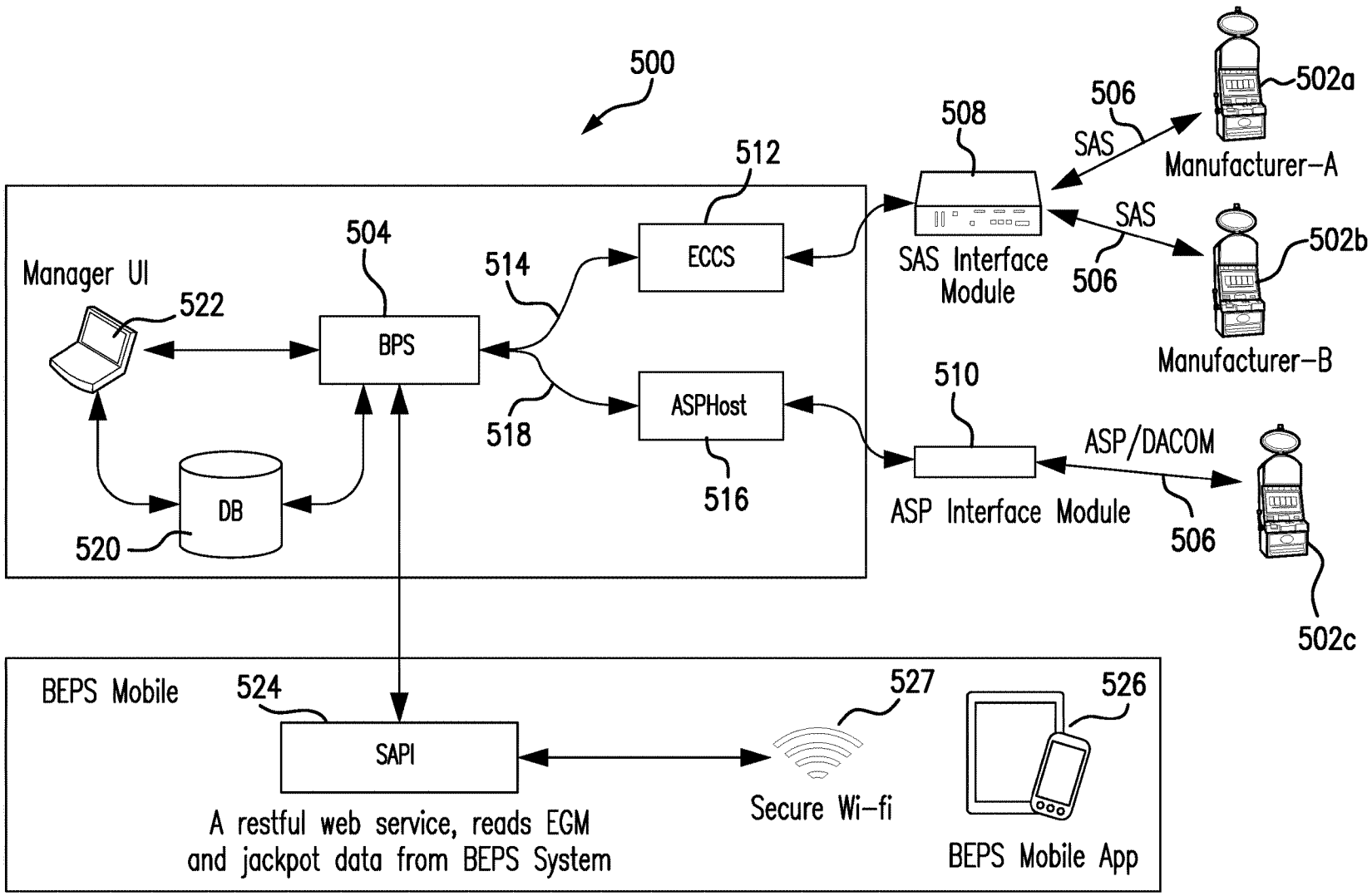
FIG. 5 is a diagram showing the arrangement of components for an embodiment of the system and method according to the present invention.

FIG. 5 shows an embodiment of the system 500 according to the present invention. At 502*a-c* are gaming machines of the type described above each of which may be from a different manufacturer and each of which hosts one or more stand-alone progressive jackpots (SAPs). To support the SAPs each gaming machine 502*a-c* has an associated progressive jackpot local controller (not shown) ("local" meaning the controller is geographically associated with the gaming machines 502*a-c* as by being installed in the gaming machine 502*a-c* cabinet or an adjacent cabinet) which may be an aftermarket local controller or part of the original configuration of the gaming machine 502*a-c*. These local controllers are known and are from various gaming machine 502*a-c* and aftermarket manufacturers. As described above the local controllers are configured by a technician to obtain coin-in data from their associated gaming machine 502*a-c*, determine, based upon their configuration, the allocation from each coin-in wager to the one progressive jackpots and reset values, increment the jackpot(s) accordingly and provide input for displays showing the current jackpot value(s). The local controllers also receive game outcome data to determine if a jackpot event has occurred. A video display associated with each gaming machine 502*a-c* is adapted to display the current values for each hosted SAP. Thus a technician physically at a SAP hosting gaming machine 502*a-c* may view the current SAP values as determined by the associated local controller.

To receive coin-in data from the gaming machines 502*a-c* to derive for each a value for their hosted SAP jackpot(s) the system 500 includes a SAP server 504 shown as BPS (for Bally Enterprise Service). The system 500 is in communication with the gaming machines 502-*c* through connections 506 to, for example, receive coin-in and game outcome information to detect when a SAP qualifying outcome has be obtained. A purpose for the system 500 and SAP server 504, as described above, is to provide a central service for monitoring and auditing the SAPs throughout the casino property such as their current values, to provide a source of back-up data and to replace the paper, written SAP logbooks. The SAP server 504 is configured to "mirror" the SAP data of the local controllers for monitoring and auditing. For SAS protocol (a Slot Accounting System communication protocol developed by and available from IGT) enabled gaming machines 502*a, b* the connection is a secondary SAS 5.0+ SAP port (or equivalent) for the gaming machine 502*a, b* and is connected to a SAS Interface Module 508, which may receive the data from several gaming machines 502*a, b*. For a gaming machine 502*c* operating with an Aristocrat Serial Protocol (ASP), Data Accounting Operations Management (ASP/DACOM) (for gaming machines 503*c* manufactured by Aristocrat Technologies, Inc.), the connections are directed to an ASP Interface Module 510. The data from the SAS Interface Module 508 is directed to Electronic Computer Control System ECCS 512 which is configured as the progressive controller front end for the system. The SAP server 504 is in communication with the ECCS 512 through a connection 514. The ASP Interface Module 510 is in communication with the ASP Host 516 which also acts as the progressive controller front end. The ASP Host 516 is in communication with the SAP server 504 through a connection 518. Accordingly the data used by the progressive controllers is also sent to the SAP server 504. Thus the ECCS 512 and ASP Host 516, which may be located remotely from the gaming machines 502*a-c* as by being associated with the SAP Server 504, receive gaming machine 502*a-c* performance data and are configured to match or mirror the operations of the SAP local controllers.

The system 500 including the SAS server 504 includes processing capabilities and is configured by suitable software corresponding to the programming of the local progressive controller and should, absent misconfiguration, malfunction or local controller reconfiguration, derive and archive the same progressive jackpot value(s) as the local SAP controllers. The received data and determined SAP values are stored in a database memory 520 whereby data for auditing of the SAPs may be retrieved through a manager interface 522. The manager interface 522 may be used to initially configure the individual SAPs at, for example, the ECCS 512 and ASP Host 516, which configuration parameters are archived in the memory 520. The memory 520 also stores, or the SAP server 504 has access to, data to identify each individual gaming machine 502*a-c* by serial number, an enterprise assigned identification number or the like. The SAP server 504 or the memory 520 associates each gaming machine 502*a-c* with its SAP server 504 determined progressive jackpot value(s).

The SAP server 504 is in communication with a SAP Interface 524 which provides a wireless enabled interface between user mobile devices 526 through a secure wireless network 527.

Figure 6:
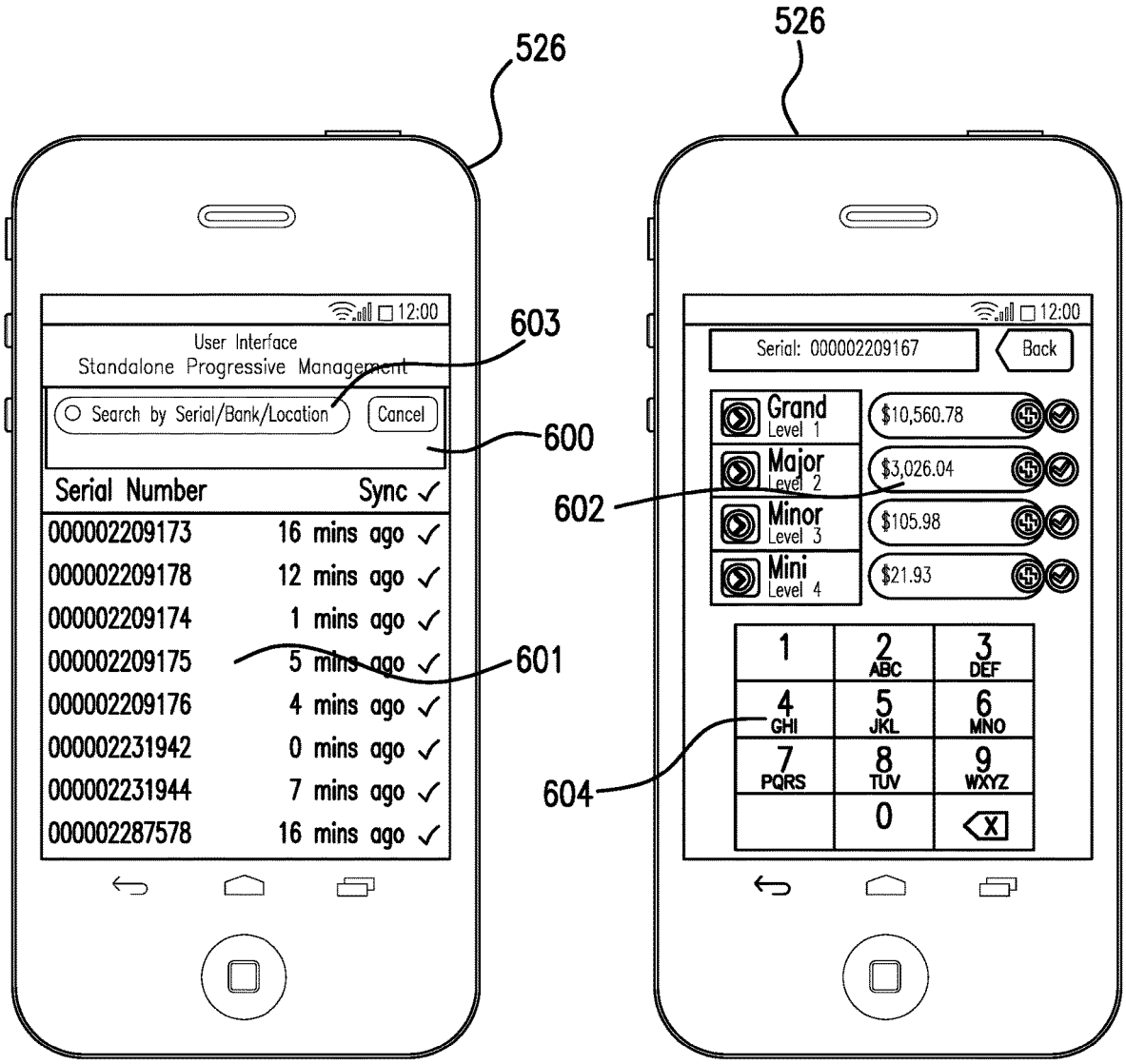
FIG. 6 shows views of displays at a user's mobile device for reconciling stand-along progressive jackpot values as between the system and local progressive jackpot controller values.

The user's mobile device 526 is configured by a suitable software application whereby the user may access the SAP server 504 and associated memory 520 to retrieve and display the current value(s) for each progressive jackpot as determined by the system 500. FIG. 6 illustrates examples of several displays which can be provided to a video display 600 at user's mobile device 526. One display at 601 displays the Serial Number for each gaming machine 502*a-c* including a SAP, the time from the last "sync" with the system 500 SAP server 504 and a query input window 603.

To sync the SAP values between those determined by the local SAP controller and those at the SAP system 500, e.g. the SAP server 504, the user goes to the gaming machine 502*a* and, through the application, opens wireless communication with the SAP Interface 524 and the SAP server 504. When communication is opened the display 600 may be provided to the user displaying a list identifying each gaming machine 502*a-c* by an identification number, e.g. serial number and the time from the last time the local and SAP server values were synched. The user may determine the serial number for the gaming machine 502*a* of interest and select that serial number from the list. In an alternative embodiment the gaming machines 502*a-c* may each bear an identifying bar code, QR code, glyph or other image. Using the camera on the mobile device 526 the user acquires an image of the code or glyph which is processed by the application, SAP Interface 524 and/or SAP host 540 to uniquely identify the gaming machine 502*a* to the SAP Host 504. The user may alternatively enter the machine 502*a* identification, machine or serial number or select the serial number from a displayed list. The application retrieves or the SAP Host 504 sends from the memory 520 its current, determined progressive jackpot values for display at the user's mobile device 526 as suggested at 602 in FIG. 6 for the selected gaming machine 502*a-c*. The user may then visually compare the values displayed at the gaming machine 502*a-c* with the values from the SAP Host 504 and memory 520. If the user determines that there is a discrepancy between the values using a displayed touch keypad 604 the user may enter the correct values displayed and determined by the local jackpot controller and the corrected values are transmitted to the SAP Interface 542, SAP server 504 and memory 520. The SAP Server 504 makes the correction to synch the values as between the SAP Server 504 and local SAP controller and stores the time of the event and data reflecting the correction for future auditing. As can be appreciated the "synching" of the values is virtually instantaneous and does not suffer from the deficiency of a technician writing the values in a logbook (which could be misplaced) and the time delay in having to get to the manager interface 522 to correct the values. The application also notes the time which the local controller values and those at the SAP sever 504 were synched.

Accordingly, the SAP Host 504 and memory 520 are configured to maintain correct and synched values for each SAP in the casino enterprise. The saved data may be audited and there is no risk of loss of physical logbooks as in the prior art. Through the manager interface 522 the SAP data may be retrieved, sorted, viewed and audited.

Although the description above contains many specificities, these should not be construed as limiting the scope of the invention but as merely providing an illustration of the presently preferred embodiment of the invention. Thus the scope of this invention should be determined by the appended claims and their legal equivalents.

What is claimed is:

1. A system for providing auditing and/or reconciliation of stand-alone progressive jackpots, the system comprising:

a plurality of gaming machines, each associated with a respective local progressive jackpot controller;

a connection for providing communication between the plurality of local progressive controllers and a stand-alone progressive server including a memory;

wherein coin-in data acquired by each said local progressive jackpot controller from its respective one of the plurality of gaming machines is used by the respective local progressive jackpot controller to calculate a value of a stand-alone progressive jackpot, the coin-in data also transmitted to the stand-alone progressive server via the connection; and wherein the stand-alone progressive server is configured to calculate, via one or more processors according to non-transitory program instructions, a server calculated value of each respective stand-alone progressive jackpot based on the received coin-in data and to store each said server calculated value in the memory;

a wireless communication host for establishing communication between the stand-alone progressive server and a mobile device for display of data representing identification of at least one of the plurality of the gaming machines and the server calculated value of its respective stand-alone progressive jackpot stored in the memory;

wherein the mobile device may be used to reconcile any discrepancies between a stand-alone progressive jackpot value displayed by the local progressive jackpot controller associated with the identified gaming machine and the server calculated value displayed on the mobile device.

2. The system of claim 1 wherein each of the plurality of gaming machines includes a visible code readable by the mobile device to identify the at least one of the plurality of gaming machines to the stand-alone progressive server.

3. The system of claim 1 wherein the stand-alone progressive server is configured to receive instructions from the mobile device to adjust the server calculated value stored in the memory to match the stand-alone progressive jackpot value determined by the gaming machine's respective stand-alone progressive jackpot controller.

4. A method for auditing and/or reconciliation of progressive jackpots, the method comprising:

providing a plurality of gaming machines, each associated with a respective local progressive jackpot controller;

providing a connection for communication between the plurality of local progressive controllers and a stand-alone progressive server including a memory;

wherein coin-in data acquired by each said local progressive jackpot controller from its respective one of the plurality of gaming machines is used by the respective local progressive jackpot controller to calculate a value of a stand-alone progressive jackpot, the coin-in data also transmitted to the stand-alone progressive server via the connection; and wherein the stand-alone progressive server is configured to calculate, via one or more processors according to non-transitory program instructions, a server calculated value of each respective stand-alone progressive jackpot based on the received coin-in data and to store each said server calculated value in the memory; and providing a wireless communication host for establishing communication between the stand-alone progressive server and a mobile device for display of data representing identification of at least one of the plurality of the gaming machines and the server calculated value of its respective stand-alone progressive jackpot stored in the memory;

wherein the mobile device may be used to reconcile any discrepancies between a stand-alone progressive jackpot value displayed by the local progressive jackpot controller associated with the identified gaming machine and the server calculated value displayed on the mobile device.

5. The method of claim 4, wherein each of the plurality of gaming machines includes a visible code readable by the mobile device to identify each respective gaming machine to the stand-alone progressive server.

6. The method of claim 4 wherein the stand-alone progressive server is configured to receive instructions from the mobile device to adjust the server calculated value stored in the memory to match the stand-alone progressive jackpot value determined by the gaming machine's respective stand-alone progressive jackpot controller.

* * * * *